United States Patent [19]

Haar

[11] Patent Number: 4,990,385

[45] Date of Patent: Feb. 5, 1991

[54] EXCHANGEABLE TRIMMING FOR A JACKET COLLAR

[76] Inventor: Herbert Haar, Mensinge 36, 1083 HC Amsterdam, Netherlands

[21] Appl. No.: 266,910

[22] Filed: Nov. 3, 1988

[30] Foreign Application Priority Data

Nov. 14, 1987 [DE] Fed. Rep. of Germany ..... 8715179

[51] Int. Cl.[5] ..... A61F 13/02

[52] U.S. Cl. ..... 428/40; 2/100; 2/139; 428/85; 428/99; 428/343

[58] Field of Search ..... 2/100, 98, 129, 139, 2/140; 428/40, 85, 99, 343

[56] References Cited

U.S. PATENT DOCUMENTS

| | | | |
|---|---|---|---|
| 2,318,829 | 5/1943 | Zimmerman | 2/48 |
| 2,725,954 | 4/1973 | Baldini | 2/98 |
| 3,860,967 | 1/1950 | Tedesco | 2/139 |
| 4,143,142 | 3/1979 | Hayden | 428/343 |
| 4,511,615 | 4/1985 | Ohto | 428/343 |

FOREIGN PATENT DOCUMENTS

| | | |
|---|---|---|
| 2056253 | 3/1981 | United Kingdom . |

*Primary Examiner*—James J. Bell

*Attorney, Agent, or Firm*—Toren, McGeady & Associates

[57] ABSTRACT

An exchangeable trimming for a jacket collar, in particular for a low-cut jacket, with the trimming underside having adhesive surfaces, makes it possible in a simple manner to convert an everyday sport coat or the jacket of a suit into an article of clothing, a tuxedo, particulary suitable for celebrations and special occasions.

5 Claims, 1 Drawing Sheet

EXCHANGEABLE TRIMMING FOR A JACKET COLLAR

TECHNICAL FIELD OF THE INVENTION

The invention relates to an exchangeable trimming for a jacket collar, in particular for a men's low-cut jacket. The probably best known low-cut men's jacket is a tuxedo, traditionally of a black fabric with silk trimming on the lapels; however, other colours and in particular for the summer also tuxedos of white linen or silk are socially acceptable. The tuxedo is as a general rule only worn to special occasions and celebrations. The ordinary man in the street has very few opportunities per year to wear a tuxedo. However he has to own a tuxedo despite the few chances he has to wear it.

OBJECT OF THE INVENTION

It is the object of the invention to provide a simple way of converting an ordinary sport coat or the jacket of a suit into an article of clothing, a tuxedo, particularly suitable for celebrations and special occasions.

BRIEF DESCRIPTION OF THE INVENTION

This object is achieved according to the invention by a collar trimming, in particular of silk, which has on the underside adhesive surfaces which are preferably distributed over the length of the trimming.

The idea underlying the invention is thus to convert a jacket, when required, into a tuxedo suitable for the special occasion by fastening to the lapels and/or collar of the jacket, by pressing on, a collar trimming which can match the colour of the jacket. To ensure that the trimming sits properly it suffices to have only a few adhesive surfaces on the exchangeable trimming; that is to say the underside of the trimming does not have to be made to adhere over its whole length and breadth.

For easy attachment, the underside of the trimming may be provided with adhesive strips which can consist of two bur-type self-adhesive bands having outer adhesive surfaces and forming with their facing surfaces a bur-type self-adhesive fastener of which the one bur-type band can be attached to the underside of the trimming. When the adhesion of the adhesive surfaces lessens, all that is needed is for the bur-type bands—e.g. as an exchangeable set—to be exchanged for new ones, and for the adhesive surface of the bur-type band to be pressed on to the underside of the trimming.

Such bur-type bands and fasteners are available under the name Velcro.

In a preferred embodiment the trimming has a V-shaped neckline and comprises a holding strip which is connected along its inner trimming edge with a reverse strip. The adhesive strips can then advantageously be arranged on the reverse strip. When converting a jacket into a tuxedo the trimming can be folded along its inner edge, that is to say the seam connecting the holding strip to the reverse strip, so that it embraces the jacket collar from the inside to the outside like a claw.

BRIEF DESCRIPTION OF THE DRAWINGS

The invention will now be described in more detail with reference to an exemplary embodiment shown in the drawings, in which.

DETAILED DESCRIPTION OF A PREFERRED EMBODIMENT OF THE INVENTION

Figure 1:
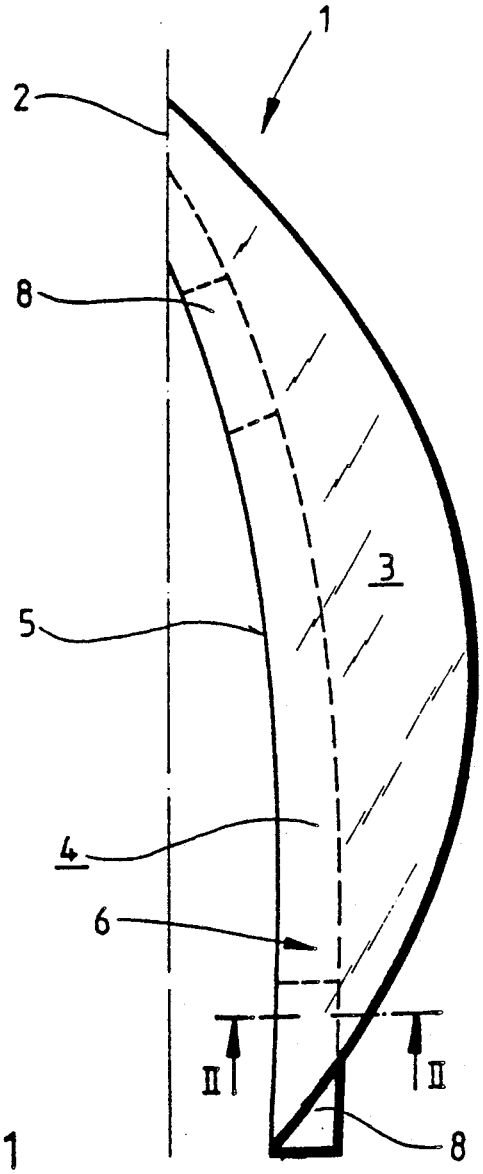
FIG. 1 shows from above half of a trimming which when complete is symmetrical and consists of two of the halves shown, having adhesive strips.

A trimming 1 comprising two strips, shown in FIG. 1, connected to one another by a longitudinal seam 2, has a holding strip 3 and a reverse strip 4; the strips 3, 4 are sewn together along the inner trimming edge 5. Distributed on the reverse 4, which is folded about the trimming edge 5 in the direction of the arrow 6 to the inside, i.e. under the underside 7 of the trimming 1 or of the holding strip 3, are adhesive strips 8, one adhesive strip 8 being arranged at the lower end and one at the upper end, i.e. in the region of the longitudinal seam 2 of the holding strip. The adhesive strips 8 have adhesive surfaces with which the trimming 1 can be attached to a jacket (not shown).

Figure 2:
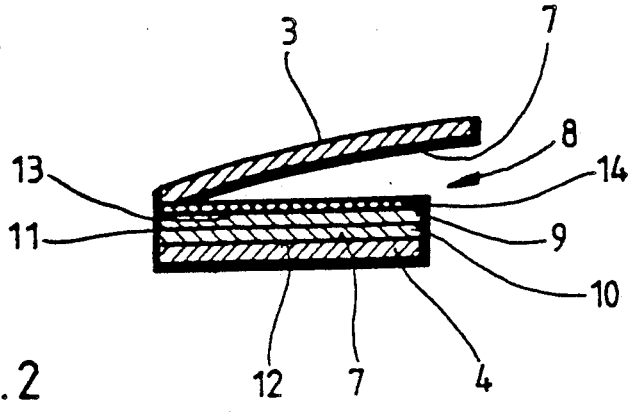
FIG. 2 shows on an enlarged scale, a cross-section along the line II—II of FIG. 1.

As is shown separately in FIG. 2, the adhesive strips 8 comprise two bur-type bands 9, 10 with their facing surfaces forming a bur-type self-adhesive fastener. The inner bur-type band 10 lying against the reverse strip 4 is fastened to the reverse strip 4 with an adhesive surface 12. The adhesive surface 13 of the bur-type band 10 on the outside which, when the reverse strip 4 is in the position shown in FIG. 2, i.e. folded under the trimming underside 7, faces the holding strip 3 projecting upwards, is protected by a paper strip 14.

To convert a jacket into a tuxedo, the paper strip 14 is removed from the adhesive surface 13, the trimming 1 is placed around the collar and the reverse of the jacket, and the reverse strip 4 is folded inside, under the jacket, whereby the jacket reverse (not shown) are situated in a gusset formed, as shown in FIG. 2, by the upstanding trimming underside 7 and the bur-type band 9 with the adhesive surface 13; by pressing lightly the trimming 1 is fastened to the jacket.

What is claimed is:

1. A jacket collar in combination with an exchangeable trimming, wherein the trimming has an underside with adhesive surfaces.

2. A jacket collar in combination with an exchangeable trimming according to claim 1, wherein adhesive strips are distributed along the length of the trimming.

3. A jacket collar in combination with an exchangeable trimming according to claim 2, wherein the adhesive strips comprise two bur-type self-adhesive bands having outer adhesive surfaces and facing surfaces which form an interlocking bur-type self-adhesive fastener when pressed together, and an inner one of said self-adhesive bands being adhered to the underside of the trimming.

4. A jacket collar in combination with an exchangeable trimming according to claim 2, comprising a holding strip and a reverse strip respectively arranged one above the other and connected to one another along one edge.

5. A jacket collar in combination with an exchangeable trimming according to claim 4, wherein the adhesive strips are arranged on the reverse strip.

* * * * *